United States Patent [19]

Kaiser et al.

[11] 3,964,395

[45] June 22, 1976

[54] ELECTRICAL PRIMER FOR PROJECTILES

[75] Inventors: Hans Kaiser, Konigsfeld; Arthur Kopf, Schramberg-Sulgen, both of Germany

[73] Assignee: Gebruder Junghans GmbH, Schramberg, Germany

[22] Filed: Oct. 11, 1972

[21] Appl. No.: 298,432

[30] Foreign Application Priority Data

Oct. 14, 1971 Germany ..... 2151245

[52] U.S. Cl. ..... 102/70.2 R

[51] Int. Cl.[2] ..... F42C 11/06

[58] Field of Search ..... 102/70.2

[56] References Cited

UNITED STATES PATENTS

| | | | |
|---|---|---|---|
| 3,603,844 | 9/1971 | Fritz | 102/70.2 A |
| 3,721,885 | 3/1973 | McKeown et al. | 102/70.2 I |

*Primary Examiner*—Charles T. Jordan

*Attorney, Agent, or Firm*—Burns, Doane, Swecker & Mathis

[57] ABSTRACT

An electrical primer for a projectile in which the charge on a capacitor is stepwise reduced by periodic timing pulses to a level at which the projectile is armed. Several embodiments of the circuit and of the timing elements are disclosed.

22 Claims, 10 Drawing Figures

I
II
III
+
20
20'
22
12
$R_T$
FF
21
18
17
19
23
$C_I$
V
STr
24
13
25
11
10
14

I
II
III
+
20
20'
22
21
18
17
19
23
$B_1$
$B_2$
$C_{RO}$
12
STr
24
13
25
11
10
14

ELECTRICAL PRIMER FOR PROJECTILES

BACKGROUND OF THE INVENTION

The invention applies to an electrical primer for projectiles with an electrical igniting element and with an ignition switch arrangement with at least one storage condenser which may be connected to the ignition element via an electronic switching element.

An electrical projectile primer of the type mentioned is already known (DAS 1 155 037). This primer contains a storage condenser which can be charged by means of a voltage source and which is connected, via a charging resistor, to an ignition condenser. The ignition condenser is switched in parallel with the electrical ignition element. In this way a voltage dependent circuit element in the form of a semiconductor diode is switched between the ignition condenser and the ignition element. When the diode attains a certain voltage, it extends to the ignition condenser, so that the charge of the ignition condenser can flow through the ignition element to ignite the primer.

In the case of primers with longer running time, it is necessary to use condensers of considerable size which make it difficult to apply them to projectiles of small caliber. In addition, the safety of the primer before and during firing is unsatisfactory. The purpose of the invention is to create an electrical primer of the type mentioned which requires only condensers of relatively low capacity and therefore can be produced with small dimensions and which furthermore provides a higher degree of safety. According to the invention, this is achieved in that the electronic switching element is an electronic coupling element which is provided with an input control, and further, that an electrical pulse generating time element is connected to the input control of the electronic triggering device.

In the case of this primer of this invention, it is no longer necessary that there be a transfer in the charge from a storage condenser, chargeable from an outside voltage source, to an ignition condenser. This transfer is only possible in an incomplete manner. The ignition storage condenser of the present invention can be charged directly so that this charge is fully available for ignition.

By means of the use of an electronic triggering device provided with an input control and the utilization of a timing element generating electrical pulses, it is possible to obtain relatively long delay periods. Furthermore, the primer of this invention makes it possible to use proven mechanical construction elements, such as those disclosed in German Patent No. 1,126,776; German Patent No. 977,787; German disclosure 1,578,483; and German disclosure 1,924,025. Preferably a control storage condenser charged by impulses is connected in series to the triggering element. The control storage condenser can be connected in parallel to the series combination of the discharge resistor and a switching device controlled by the timing element. For this purpose a controllable electronic circuit element can be provided as a switching device.

An electronic oscillator circuit can be provided as the timing element fed by another storage condenser. However, a mechanically driven rotary oscillator, preferably a balance wheel, can also be provided as the timing element.

A coil arrangement and a permanent magnet arrangement influencing the coil arrangement and movable with respect thereto may be provided for controlling an electronic circuit element. In case a mechanically operated rotary oscillator is used, the coil arrangement or the permanent magnet arrangement can be attached to this rotary oscillator.

However, as the timing element, one may also use a mechanical driving gear equipped with a braking control released by a plate spring. In this case the coil arrangement or the permanent magnet arrangement can be placed at the release plate spring. For the purpose of controlling the controllable electronic circuit element, it is also possible to use a piezoelectric crystal which is connected to the release plate spring.

Preferably a safety circuit is connected to the ignition circuit which preferably separates the igniting element from the ignition circuit in a bipolar manner, whereby an acceleration driven or centrifugal force driven safety element is provided which, after firing of the projectile, activates the safety circuit to switch the igniting element into the ignition circuit.

An activating element under spring action, blocked by the safety element, can be connected to the safety switch, whereby the activating element can be provided with a starting device for the timing element. This starting device may be a starting spring for a rotary oscillator. When an electronic oscillator circuit is used as the timing element, the starting device may also be a switching device to activate this oscillator circuit.

The primer of the present invention is suitable both for rifled projectiles and for smooth bore projectiles such as rockets.

A high degree of accuracy in setting the fuse can be achieved with the primer of this invention. In conjunction with additional mechanical safety devices, one obtains a primer which is extremely safe to handle and quick to operate.

It is accordingly a general object of the present invention to obviate many of the deficiencies of known primers and to provide a novel primer and method of priming a projectile.

These and many other objects and advantages of the present invention will become apparent to one skilled in the art to which the invention pertains from the claims and from a perusal of the following detailed description when read in conjunction with the appended drawings.

THE DRAWINGS

THE DETAILED DESCRIPTION

Figure 1:
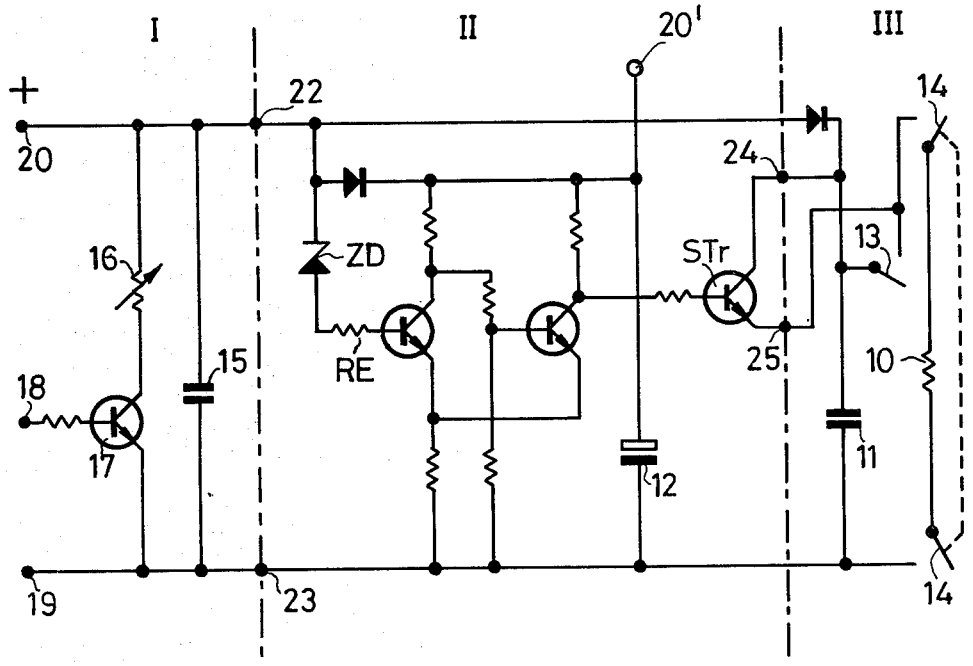
FIG. 1 is a schematic circuit diagram of one embodiment of the electrical primer of the invention.

With reference to FIGS. 1 to 4, the ignition circuit III is the same with an electrical ignition element 10 which is released by a flow of current from the ignition condenser 11 to which voltage can be fed from the outside through the terminals 19 and 20.

A current source, for example a condenser 12, provides current to a triggering element II which differs in the various examples given herein. An inertial switch 13 is closed when the projectile strikes to release an ignition element 10 in the event that the triggering element II has not yet been activated. A double-pole, single-throw safety switch 14 is normally open and is closed only after the firing of the projectile, possibly after a certain delay time, through acceleration effects or centrifugal force effects, to connect the ignition element 10 to the ignition circuit.

Figure 2:
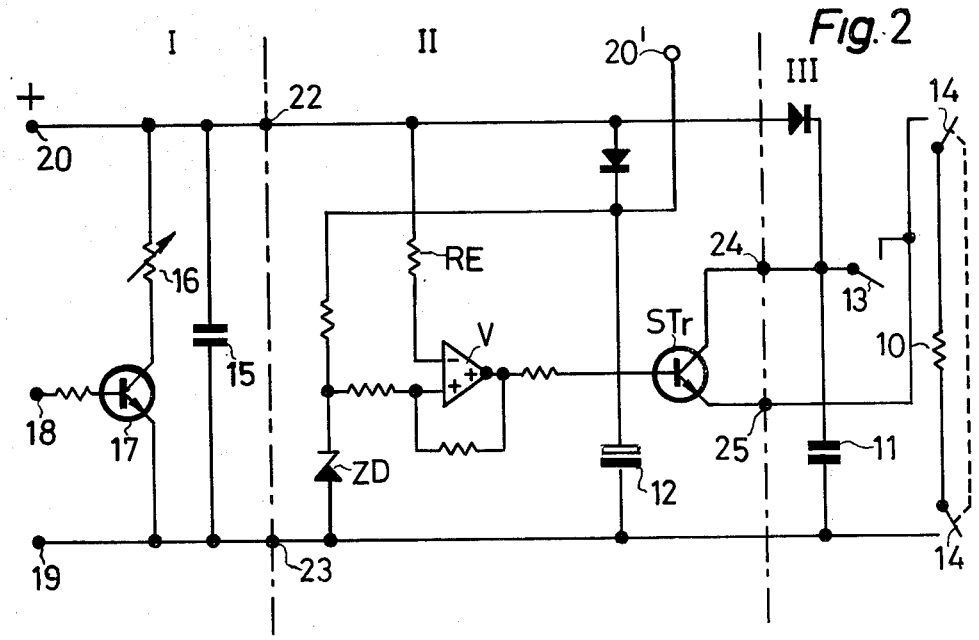
FIG. 2 is a schematic circuit diagram of another embodiment of the electrical primer of the invention.

Stage I of the circuits of FIGS. 1 to 4 is also essentially the same. In each figure the circuit contains an NPN transistor 17, input terminals 19 and 20, and a control terminal 18. In the circuits of FIGS. 1 and 2, stage I also contains a control storage condenser 15 parallel to the series combination of the collector-emitter path of the transistor 17 and an adjustable resistor 16.

Figure 3:
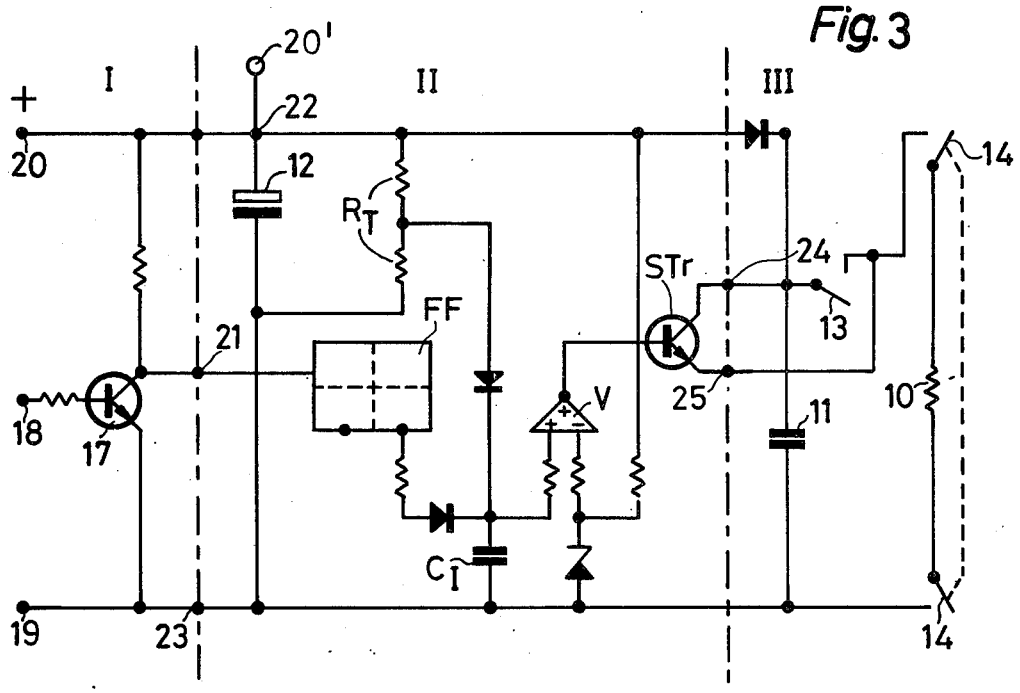
FIG. 3 is a schematic circuit diagram of another embodiment of the electrical primer of the invention.
Figure 4:
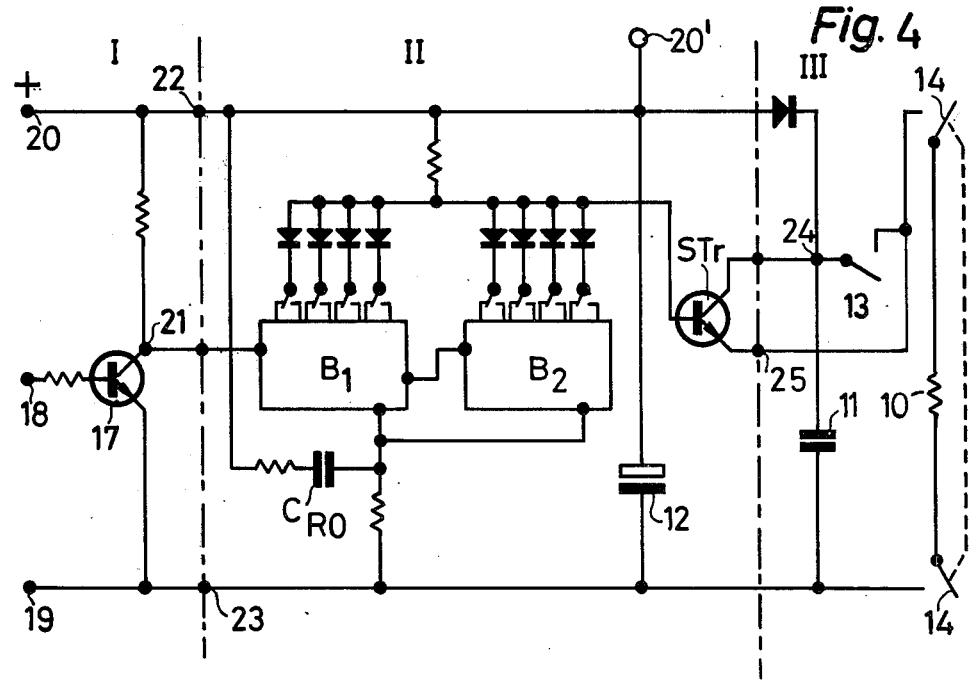
FIG. 4 is a schematic circuit diagram of another embodiment of the electrical primer of the invention.

The electronic triggering element of stage II is different in the various examples of FIGS. 1 to 4. In all cases, however, the element has an NPN switch transistor STr with two terminals 24 and 25 by means of which switching of the ignition circuit is effected. In FIGS. 1 and 2, the input terminals 22 and 23 of the triggering element II are disposed across the control storage condenser 15. The control storage condenser 15 is also chargeable directly through the input terminals 19 and 20. Parallel to the control storage condenser 15 there is the resistor 16 in series with the NPN transistor 17. In FIGS. 3 and 4 the input terminals of the triggering element are denoted by 21, 22 and 23.

In all cases the input terminals of the transistor 17 are denoted by 18 and 19. A timing element which delivers a pulse may be connected to the terminals 18 and 19. By means of these pulses the transistor 17 can be periodically driven into conduction whereby each time a certain discharge of the control storage condenser 15 takes place through the resistor 16. The electronic triggering element II, which can be of any kind, is made in such a way that a circuit is formed to connect the terminals 24 and 25 together when the voltage applied to the input terminals 22 and 23 has fallen below a certain level, or when a previously determined number of pulses have been fed to the triggering stage II. If switching of the electronic triggering element II occurs after the switch 14 has been closed, then the ignition circuit is closed.

The adjustable discharge resistor 16 shown in FIGS. 1 and 2 serves to adjust the RC time constants to the frequency of the pulses occurring at the terminals 18 and 19. According to the pulse source used, the resistor 16 is adjusted during assembly in such a way to activate the electronic triggering element II. After a predetermined number of pulses the voltage at the terminals 22 and 23 falls below the mentioned voltage limit value.

The ignition circuit arrangement is composed of the construction groups I, II, and III which are shown in the drawing by dashed lines.

In the example in FIG. 1, a Schmitt trigger circuit is provided as the electronic triggering element and it is controlled by a Zener diode ZD. The circuit represented is suitable for analog or digital control of uniform pulses. The input stage with the condenser 15 and the resistors 16 and RE determine the time constant.

The circuit in FIG. 2 contains as the triggering element a differential amplifier V with hysteresis which is acted upon by the input stage I through a resistor RE. The amplifier V switches on the switching transistor STr for the ignition circuit as soon as its input voltage corresponds to the reference voltage. This circuit is appropriate for analog or digital control.

In the circuit of FIG. 3, a flip-flop circuit FF in conjunction with a differential amplifier V is used as the triggering element. The input stage I controls the monostable flip-flop circuit FF which determines the length and height of the pulses. The precisely defined pulses are integrated with the aid of the condenser $C_I$, and the voltage of the condenser $C_I$ is compared with the reference voltage of the differential amplifier V. As soon as the voltage at the condenser $C_I$ reaches the reference voltage, the differential amplifier V delivers an output potential which causes the switching of the switching transistor STr, whereby the ignition circuit is closed and the ignition current is released.

Setting of the primer is made possible by changing the voltage which is applied to the terminals 19 and 20. Thus the condenser $C_I$ is biased variably through the voltage divider $R_T$. The circuit in FIG. 3 is suitable for digital control with variable pulse ratios.

FIG. 4 shows a circuit which is suitable for digital control and in which the pulses applied at the terminals 18 and 19 are amplified in stage I and are passed to the input terminal of an 8-bit binary counter (illustrated as being composed of two 4 bit-ICs $B_1$ and $B_2$). In accordance with the coding of the diode gate, it is possible here to achieve a control of the switching transistor STr at any pulse between one and 250 pulses. The condenser $C_{RO}$ serves here to set the counter to zero position during the charging of the condenser 12.

Figure 5:
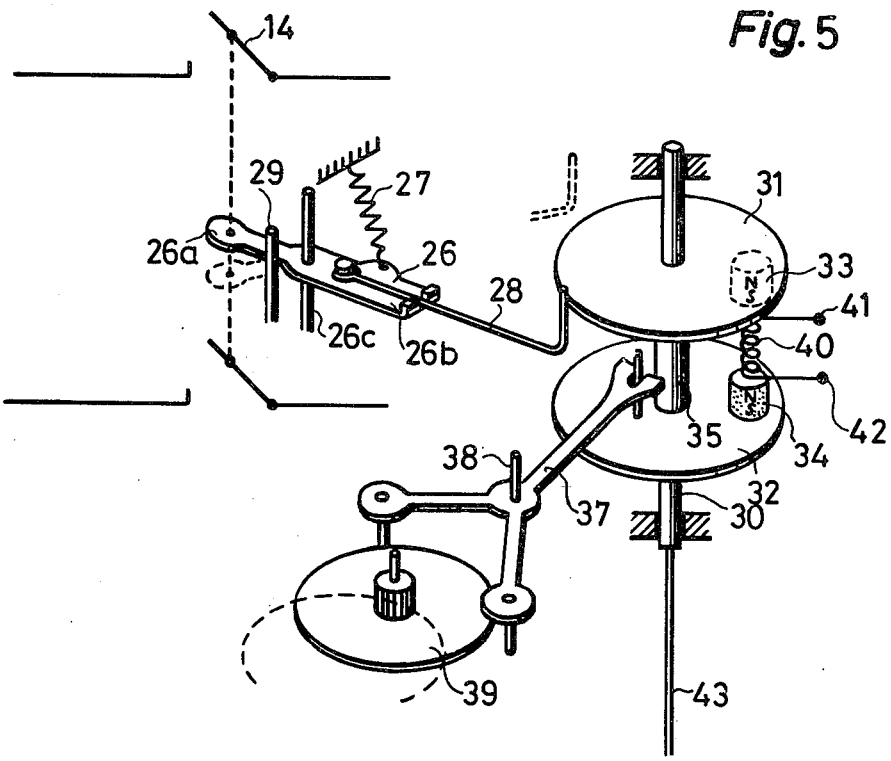
FIG. 5 is a pictorial view of a mechanical timing element and of a safety element influencing the primer.

FIG. 5 shows a possible pulse generator. It is composed of a rotary oscillator which is driven mechanically through a gear 39 and a movable fork 37 situated around an axis 38 such as a balance wheel. On the shaft 30, the balance wheel carries two magnetically conductive discs 31 and 32, each one of which carries a permanent magnet 33 and 34. The grounding occurs through the discs 31 and 32 and the magnetically conductive part 35. In the air gap located between the permanent magnets 33 and 34 there is an induction coil 40, the ends of which are attached to the terminals 41 and 42. The balance wheel is also provided with a release spring in the form of a span wire 43.

During an oscillation of the balance wheel, pulses are generated in the induction coil 40 at each zero passage and these pulses are fed to the terminals 18 and 19. In this way the transistor 17 is periodically controlled, and the condenser begins to discharge through the compensating resistor 16 and the collector-emitter path of the transistor 17 until the transistor 17 is driven into cutoff after termination of the input voltage. There is thus obtained a step-by-step discharge curve, as shown for example in FIG. 10. After certain number of pulses, i.e., at the point of time $t_2$, the voltage at the condenser 15 has dropped to a value $U_2$ which corresponds to the limit value of the input voltage of the triggering element II. Thus, at this point of time $t_2$, the triggering element is activated, i.e., the terminals 24 and 25 are connected to one another to close the ignition circuit.

In FIGS. 3 and 4 the condenser 15 is not provided since in these examples the time constant is no longer formed by the capacitor 15 and the resistor 16.

Figure 6:
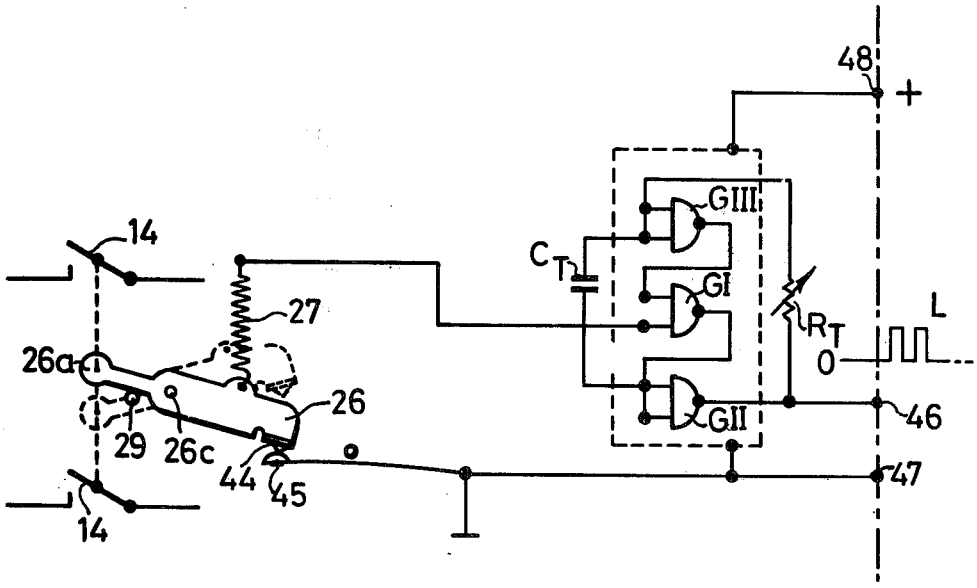
FIG. 6 is a schematic circuit diagram of an electronic timing element affecting the primer of FIGS. 1 – 4, and of a safety element.

The safety circuit 14 shown in FIGS. 1 to 6 may be connected with an activating device 26 of FIGS. 5 and 6 which is charged by spring element 27. In this case, this activating element is a lever which can revolve about an axle 26*c*, and is connected at one end 26*a* to the switch contacts 14. In this position, the activating device 26 is held by a pin 29 which is part of a safety device, as it is generally known and described, for example, in one of the patent publications indicated at the beginning of this specification. Such safety device contains, for example, a mechanism delayed by a braking element, which is activated by acceleration force or centrifugal force.

In the example shown in FIG. 5, the operation mechanism 25 has a starting spring 28 at one end 26*b* which, at the rest position of the device 26, is adjacent to the disc 31 of the balance wheel and holds it in place. The end 26*b* is brought to the position shown in FIG. 5 by a dashed line when the device 26 swings horizontally to set the balance wheel in motion. At this moment the pulse generation begins in the induction coil 40, the ends of which 41 and 42 are attached, for example, to the terminals 18 and 19. In the case of the circuits in FIGS. 1 and 2, there thus begins the step-by-step discharge of the condenser 15.

In actual practice, the projectile, for example, a trench motar grenade, provided with the primer of the invention can be placed into the trench motar so that the terminals 19 and 20, connected to the grenade, for example, with contact rings, come into contact with opposite contacts solidly set in the trench motar. In this way the condensers 11, 12, and 15 are charged to a certain voltage such as the voltage which corresponds to setting the fuse.

Through the acceleration forces or through the developing centrifugal force when the projectile is fired, there is released a known safety chain which is connected with the part 29. When the activation device 26 is released by the pin 29, then the switch 14 is closed and the balance wheel 31, 32 is set in motion. By means of the pulses generated in the coil 40 the condenser 15 is periodically discharged via the transistor 17 until such time as, in the described manner, the voltage at the terminals 22 and 23 has attained a marginal value at which the triggering element II is switched over to connect the terminals 24 and 25. Since the switch 14 is already closed, the electrical charge which is stored in the condenser 11 can now flow across the electrical ignition element 10 and cause it to detonate. If the grenade strikes a target prior to the completion of the preset delay time, then the switch 13 is closed and the ignition is thus released.

To generate the pulses controlling the transistor 17, it is also possible to use an electronic oscillator circuit. In FIG. 6 such a circuit example of a simple electronic multivibrator is shown as the oscillation generator. Here the activating device has, instead of the starting spring 28, a contact 44 sitting on a contact spring 15 when the primer is in the safety position. When, as already described, the activating device is released by the pin 29, then the contact 44/45 opens to activate the multivibrator. The output signal of the gate GI jumps to logic level ZERO and the output signal of the gate GII jumps to logic level ONE. Via $R_T$, the input signal of the gate GIII with respect to the time constant becomes positive, whereby the output signal level changes from ONE to ZERO. In that way, the output signal from the gate GI once again goes to ONE to set the output signal of the gate GII to ZERO via $R_T$. Then the positive potential at the input of the gate GIII is once again removed, and the output signal jumps to ONE. In this way, the output level of the gate GI is set to ZERO which brings the output level of the gate GII once again to ONE. The time necessary for this process depends on the capacitor $C_T$ and the resistor $R_T$. The exact frequency can be adjusted by changing $R_T$.

The circuit has output terminals 46 and 47 which are connected to the terminals 18 and 19 of the transistor 17. The circuit is connected by means of terminal 48 to terminal 20, and thus to the plus side of the condenser 12 with the power supply.

Figure 7:
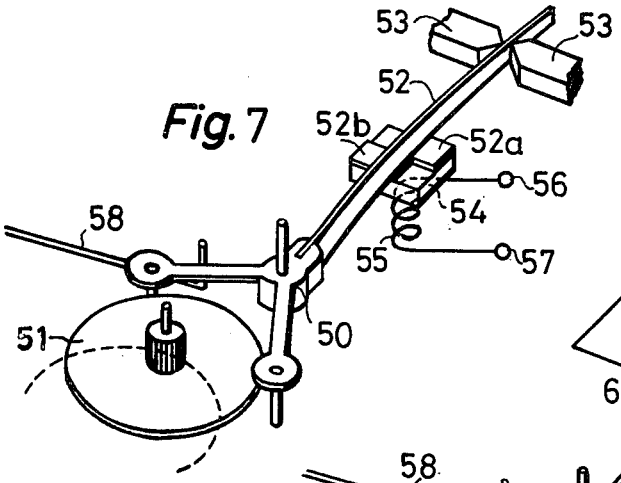
FIG. 7 is a modified form of a mechanical timing element.

FIG. 7 shows a modified arrangement for generating pulses. This concerns a mechanical mechanism having a wheel 51 which works together with a braking control 50, which is in turn released by a plate spring 52 held by the parts 53. This braking control 50 is held back by a safety element 58. As already explained, after firing the safety element 58 moves in such a way that the braking control 50 is released. At the plate spring 52, with the aid of offset lugs 52*a* and 52*b*, a permanent magnet system 54 is fastened which operates together with an induction coil 55. The terminals 56 and 57 are brought to the input terminals 18 and 19 of the transistor 17.

Figure 8:
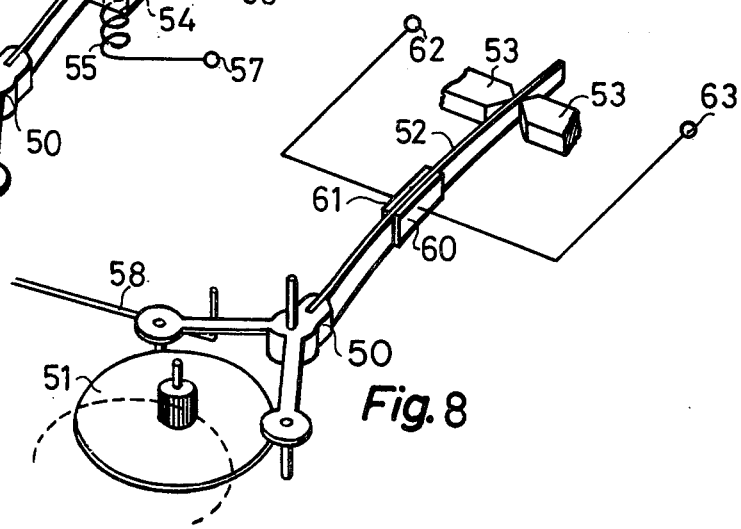
FIG. 8 is another modification of a mechanical timing element.

The control of the transistor 17 can also be achieved in the manner shown in FIG. 8. In this case the plate spring has two piezoelectric crystals 60 and 61 which are connected with the terminals 62 and 63. These terminals are connected to the input terminals 18 and 19 of the transistor 17.

Figure 10:
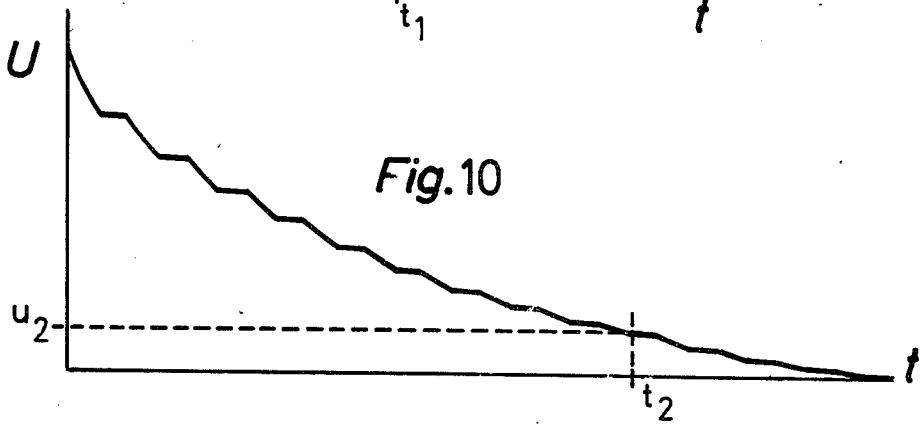

As already explained, FIG. 10 shows the step-by-step discharge of the control storage condenser 15 in FIGS. 1 and 2. Through the step-by-step discharge, we obtain a relatively long discharge time, namely, up to the point of time $t_2$ after which the ignition is released.

Figure 9:
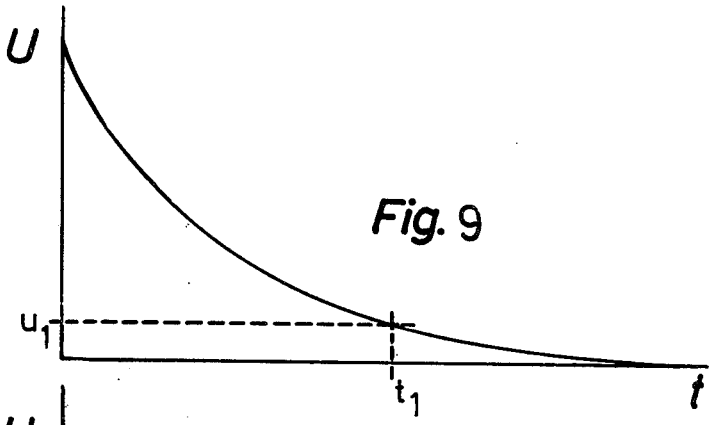
FIG. 9 is a graph illustrating the operation of a well-known electrical primer; and, FIG. 10 is a graph illustrating the operation of the primer of the invention.

In the case of the known primers which were mentioned at the beginning, the time delay takes place by means of transferring one charge which is located on a storage condenser to an ignition condenser through a compensating resistor. The time which can be thus attained is shown in FIG. 9. It amounts here to $t_1$.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In an electrical primer for projectiles with an electrical igniting element and with an ignition circuit system having at least one condenser connected to the igniting element through an electronic switch element, the improvement wherein the electronic switch element is an electronic triggering element having control input terminals and a timing element for generating electrical pulses for application to the control input terminals of said tilting element.

2. An electrical primer according to claim 1 wherein the triggering element is connected in series with a control condenser charged by the pulses from said timing element.

3. An electrical primer according to claim 2 wherein said control condenser is connected in parallel with the series combination of a discharge resistor and a switch device controlled by said timing element.

4. An electrical primer according to claim 1 wherein said triggering element includes a Schmitt-trigger circuit (FIG. 1).

5. An electrical primer according to claim 1 wherein said triggering element includes a differential amplifier with hysteresis.

6. An electrical primer according to claim 1 wherein said triggering element contains a flip-flop circuit and a differential amplifier.

7. An electrical primer according to claim 1 wherein said triggering element contains a binary counter.

8. An electrical primer according to claim 1 wherein said switching device is in the form of a controllable electronic switch element connected in series with said electronic triggeringg element.

9. An electrical primer according to claim 1 wherein said timing element includes an electronic oscillator circuit.

10. An electrical primer according to claim 1 wherein said timing element is a mechanically operated rotary oscillator.

11. An electrical primer according to claim 8 wherein said electronic switch element is controlled by a coil system and a permanent magnet system affecting the coil system and movable with respect thereto.

12. An electrical primer according to claim 10 wherein one of said coil system and said permanent magnet system is attached to said rotary oscillator.

13. An electrical primer according to claim 11 wherein one of said coil system and said permanent magnet system is attached to said rotary oscillator.

14. An electrical primer according to claim 1 wherein said timing element includes a mechanical device with a braking control released by a plate spring.

15. An electrical primer according to claim 14 wherein one of said coil system and said permanent magnet system is connected to a realease plate spring.

16. An electrical primer according to claim 14 wherein said controllable electronic switch element is controlled by a piezoelectric crystal attached to said release plate spring.

17. An electrical primer according to claim 1 including a safety switch connected to the ignition circuit which separates the igniting element from the ignition circuit, and a safety element responsive to acceleration or centrifugal force after firing of the projectile to activate said safety switch and thus connect the igniting element into the ignition circuit.

18. An electrical primer according to claim 17 wherein said safety switch includes an activating element under spring action and braked by said safety element and wherein said activating element is provided with a starting device for said timing element.

19. An electrical primer according to claim 10 wherein said rotary oscillator includes a starting spring as the starting device.

20. An electrical primer according to claim 9 wherein said electronic oscillator circuit includes a switching device as the starting device.

21. An electrical primer according to claim 18 wherein said rotary oscillator includes a starting spring as the starting device.

22. An electrical primer according to claim 18 wherein said electronic oscillator circuit includes a switching device as the starting device.

* * * * *